United States Patent [19]

Salvarezza

[11] 4,241,809

[45] Dec. 30, 1980

[54] ROPE LADDER WITH MOLDED HARD ELASTOMER STEPS AND A METHOD FOR ASSEMBLY OF THE SAME

[76] Inventor: Robert M. Salvarezza, 110 Braemar Dr., Hillsborough, Calif. 94010

[21] Appl. No.: 66,000

[22] Filed: Aug. 13, 1979

[51] Int. Cl.[3] ..... E06C 1/56

[52] U.S. Cl. ..... 182/199; 182/46; 182/228

[58] Field of Search ..... 182/196, 197, 198, 199, 182/228, 46

[56] References Cited

U.S. PATENT DOCUMENTS

| | | | |
|---|---|---|---|
| 800,934 | 10/1905 | McArthur | 182/199 |
| 1,910,546 | 5/1933 | Hoch | 182/198 |
| 3,128,843 | 4/1964 | Anagnostou | 182/198 |
| 3,415,341 | 12/1968 | Hostetler | 182/198 |
| 4,177,878 | 12/1979 | Salvarezza | 182/199 |

*Primary Examiner*—Reinaldo P. Machado
*Attorney, Agent, or Firm*—Owen, Wickersham & Erickson

[57] ABSTRACT

A rope ladder. Each step is a molded one-piece hard elastomer member having a pair of rope-receiving openings, the upper outlet from which closely confines a pair of ropes, while the bottom of the opening is much wider. Each opening tapers inwardly from bottom to top, and each step has a pair of vertical bolt openings therethrough adjacent each opening. A separate wedge collar for each opening bears against the bottom of each step and has a single through opening; at its upper end the opening is the same width as the lower end of the step's opening, and it tapers inwardly down to an outlet that closely confines the two ropes. Each wedge collar has a pair of vertical bolt passages aligned with those of the step to enable bolting the step to the collar. A generally diamond-shaped wedge heart is wedged in between the two ropes of each pair, lying partly inside the opening through the step and partly inside the opening through the wedge collar. The wedge heart has an upper vertex, a lower vertex, and two rope-engaging side grooves, which lock the pair of ropes in place.

12 Claims, 14 Drawing Figures

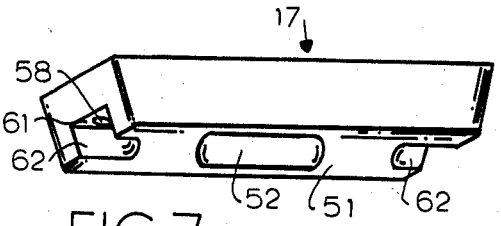
FIG.7
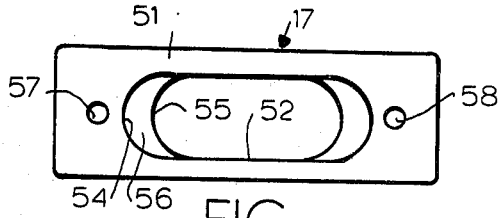
FIG. 8
FIG. 9
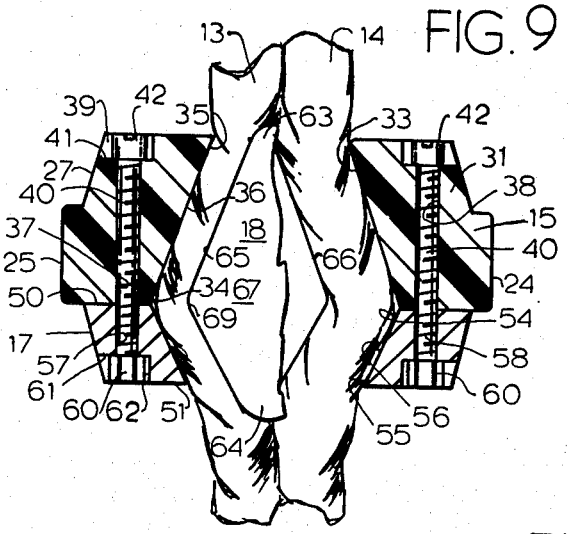
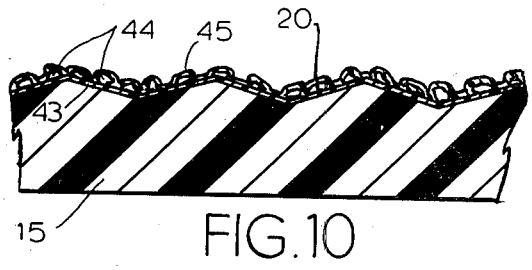
FIG.10
FIG.11
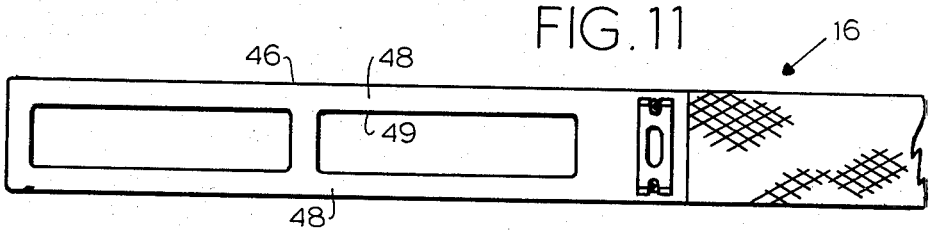
FIG.12
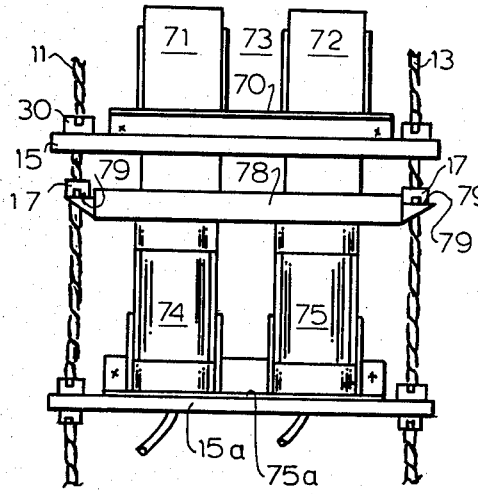
FIG.14
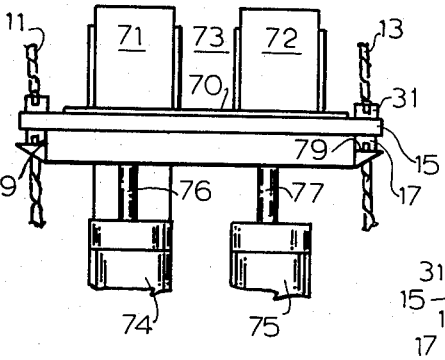
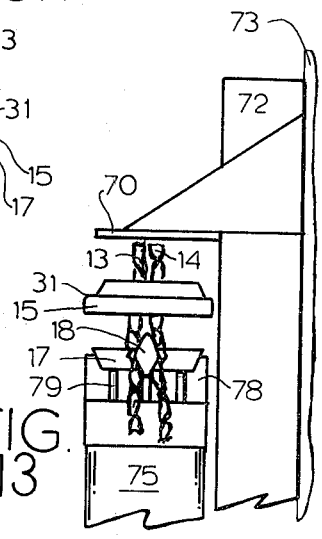
FIG. 13

ROPE LADDER WITH MOLDED HARD ELASTOMER STEPS AND A METHOD FOR ASSEMBLY OF THE SAME

BACKGROUND OF THE INVENTION

This invention relates to an improved rope ladder and to a novel step therefor, as well as to assembly of the ladder.

Rope ladders, which are especially useful as pilot's ladders by which a local pilot boards or leaves a ship, have heretofore been made with wooden or metal steps. The present invention incorporates a molded elastomer step of hard rubber-like material.

In a copending application Ser. No. 933,645, filed Aug. 14, 1978 and now U.S. Pat. No. 4,177,878, I disclosed a rope ladder of the type in which there are two ropes on each side of each step and in which a novel wedging device is used to make the attachment secure. In the present invention, I am able to incorporate into the molded step, part of a similar but significantly different wedging system, thereby giving even surer and more reliant structure, since part of it is integral with the step itself. This new wedging system more tightly holds the ropes even when they are elongated.

The breakage and non-uniformity of wooden steps has long been a problem, and the use of molded elastomer greatly reduces breakage and gives improved quality control. Also, the elastomer has more resilience and so better receives strong impacts. It will not flex or bend under average work load, but on the other hand can yield to very strong loads or impacts without actually breaking.

Furthermore, the rope ladder of the present invention is simpler to make and to assemble than were previous wooden-step ladders, and the invention lends itself to a novel form of assembly that also places elongating force on the rope and secures the rope more securely as a result.

SUMMARY OF THE INVENTION

The rope ladder of this invention has a series of molded, one-piece ladder steps, each with an upper surface and a lower surface, two longitudinal edges and two end edges, and each step has two spaced-apart vertical through openings, one spaced in from each transverse edge. These steps are used with two spaced-apart pairs of ropes, each pair of ropes passing through one through opening of each step.

Each step is molded from hard elastomer. At the upper end of each rope opening is an integral wedging portion surrounding that opening on and above the step's upper surface. Each opening, at its outlet from this wedging portion, is approximately twice the diameter of each rope, so that it closely confines the two ropes. The opening there is much wider than where it emerges from the lower surface, and each opening is tapered inwardly from bottom to top. Each step also has a pair of vertical bolt openings therethrough adjacent each through opening.

There is a pair of separate wedge collars for each step, one at each end of and below the step and bearing up against it. Each wedge collar has a step-engaging end wall and a distal end and a single elongated through opening, through which one pair of ropes passes and which at said step-engaging end is approximately the same width as the opening through the step where it abuts it. The opening through the wedge collar tapers inwardly down to a narrower portion at the distal end, which is barely wide enough for the two ropes to pass therethrough. Each wedge collar has an elongated pair of vertical bolt passages therethrough aligned with the bolt openings through the step.

A generally diamond-shaped wedge heart lies in between the ropes of each pair, a wedge heart lying partly in the through opening of each step and extending into the adjacent opening through the wedge collar. The wedge heart has an upper vertex adjacent said upper outlet of said step's opening and a lower vertex at its lower end adjacent the bottom of the opening through the wedge collar. The wedge heart provides two rope-engaging side grooves extending between and ending at these vertices; these grooves are in the assembly parallel to the opposite walls of the openings through the step and collar, respectively, so that these rope-engaging grooves, when the wedge heart is fully wedged in place, lock the pair of ropes in place and prevent relative movement between the ropes and the step, the wedge collar and the wedge heart.

A pair of bolts, each fastened with a nut, extends through the bolt passages of the wedge collar and the bolt openings of the step, and hold the wedge collar and wedge heart in place, locking the ropes in fixed position relative to the wedge heart, the step, and the wedge collar.

In addition, the ladder steps are provided with a non-slip surface and with strengthening structure.

The invention also includes a novel method of ladder assembly in which the wedging action is assured by tightening the parts together while also stretching the rope.

BRIEF DESCRIPTION OF THE DRAWINGS

In the drawings:

FIG. 7 is an isometric view from below of one of the wedge collars used in conjunction with the step and the wedge heart to secure the ropes in place.

FIG. 8 is a top plan view of the wedge collar of FIG. 7.

FIG. 9 is an enlarged fragmentary view in section taken along the line 9—9 in FIG. 2, showing the combination of a pair of ropes with the step and its integral wedge portion and with a separate wedge collar at the bottom, and with the wedge heart, which is broken away to show the bottom of its groove on one side as well as the outer wall of its groove on the other side.

FIG. 10 is an enlarged fragmentary view in section of a portion of the molded step.

FIG. 11 is a fragmentary top plan view of approximately half of one of the elongated steps.

FIG. 12 is a view in front elevation showing a stage in the assembly of one step with the ropes and collar, the installing apparatus being at its beginning position, not yet tightened.

FIG. 13 is a somewhat enlarged view in side elevation of a portion of FIG. 12.

FIG. 14 is a view similar to FIG. 12 showing the assembly tightened together, the bottom portions being broken off to conserve space.

DETAILED DESCRIPTION OF THE INVENTION

Figure 1:
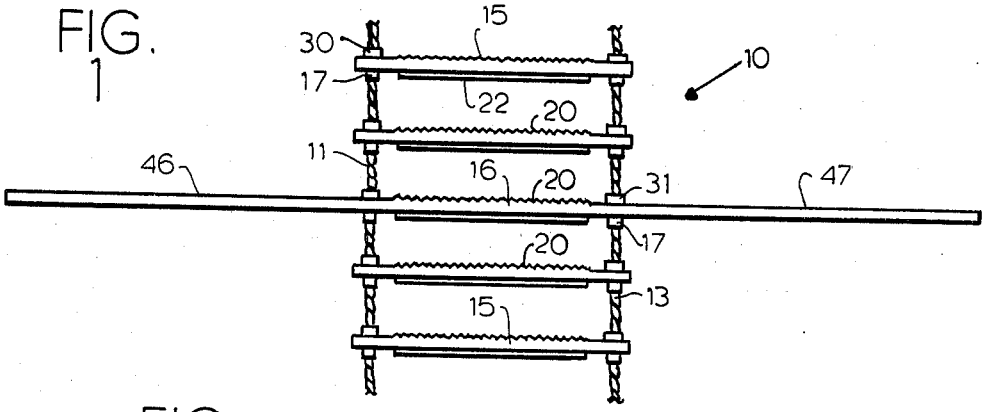
FIG. 1 is a view in front elevation of a portion of a rope ladder embodying the principles of the invention and showing an elongated step in between several normal steps.
Figure 2:
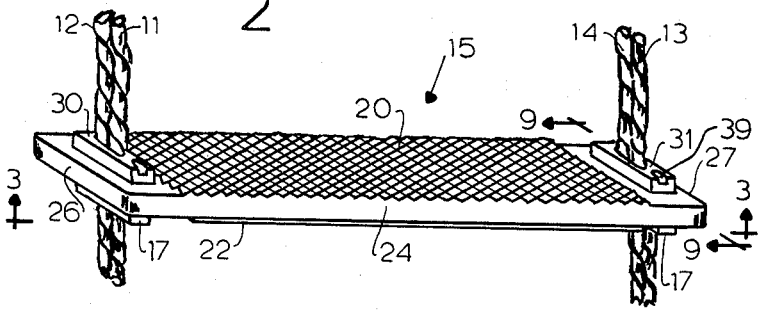
FIG. 2 is a fragmentary isometric view of one of the steps of the ladder, showing the ropes and other parts of the assembly.
Figure 5:
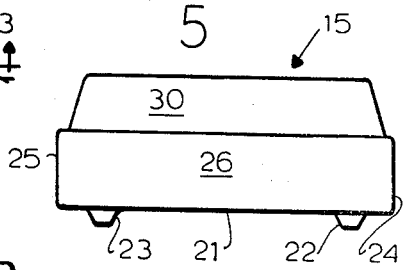
FIG. 5 is an end view taken along the line 5—5 in FIG. 4, at a slightly reduced scale.
Figure 3:
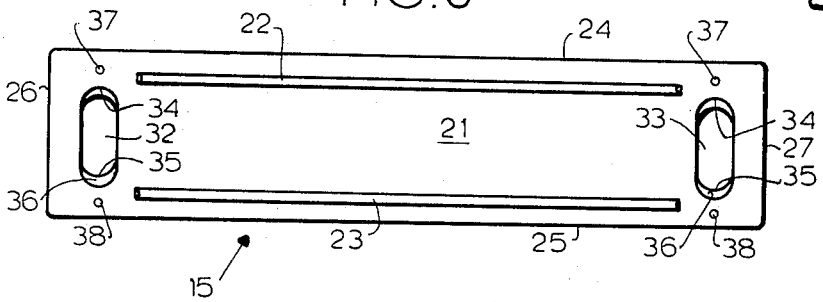
FIG. 3 is a bottom plan view of one of the steps, viewed in the direction of the arrows 3—3 in FIG. 2.

FIG. 1 shows a portion of a rope ladder 10 embodying the invention. The ladder 10 is especially useful as a pilot's ladder for boarding and leaving ships and comprises four ropes distributed as two pairs of ropes 11,12 and 13,14, one pair at each side of the ladder 10. The ladder 10 further comprises a series of regular steps 15 and, at intervals usually as prescribed by the United States Coast Guard, a series of elongated steps 16, which extend out well beyond the rope pairs 11,12 and 13,14, and help to keep the ladder 10 from turning or twisting relative to the side of a ship. In addition, the invention comprises two wedge collars 17 and two wedge hearts 18 for each step 15 or 16.

The step 15, as shown in FIGS. 2 through 5, 9, and 10, is a unitary one-piece molded member made from a suitable hard elastomer, such as a hard synthetic rubber composition. It has some flexibility but is not readily bent or flexed by hand. The step 15 has an upper tread surface 20 which is shaped to reduce the liklihood of skidding or sliding thereon. The step 15 also has a lower surface 21, which preferably includes a pair of strengthening ribs 22 and 23. The step 15 has vertical front and rear edges 24,25 and end edges 26 and 27.

Moreover, the step 15 has near or at each end 26,27 an integral, upwardly extending, rope-engaging portion 30,31 which is molded out with the step 15 of the same elastomer and at the same time, so that the portions 30 and 31 are simply parts of the step 15. Down through each portion 30,31 is a through opening 32 or 33. Along the lower surface 21 and at each end of the step 15 is an entry opening 34 for each through opening 32,33. This entry 34 is wide and cooperates with the wedge heart 18 in a manner as will be seen later. At the upper end of each portion 30,31 is an outlet 35 from the opening 32,33 which is narrow, preferably barely wide enough for the two ropes 11,12 or 13,14 to pass out, so that they are fairly snug there. The inside surface 36 in between the entry 34 and outlet 35 is tapered and, being curved, acts like a groove to receive the round ropes.

In addition to the vertical through openings 32,33, each end of each step 15 has a pair of vertical bolt openings 37,38 extending down through the portion 30,31 and through the entire step. At the top, recesses 39 (See FIG. 4) are provided to help receive a bolt 40 and to provide a bearing surface 41 for its head 42 (See FIG. 9).

As shown in FIG. 10, the non-skid aspect of the upper surface 20 may be enhanced by first spraying a suitable paint 43 of a type which will adhere to that surface, then adding to it grit 44 and then coating with paint 45 again so as to bond the grit 44 to the paint 43,45 and through it to the step 15.

The elongated steps 16 are like the steps 15 except that they have outward outboard portions 46 and 47 which may comprise hard rubber rims 48 with openings 49 therethrough to save material and lighten the step while not decreasing its effectiveness for the purpose.

A wedge collar 17 is shown in FIGS. 7 and 8 as well as in FIG. 9, and comprises a metal member basically like that disclosed in the previous application Ser. No. 933,645, filed Aug. 14, 1978. Each wedge collar 17 has an upper surface 50 and a lower surface 51 and a through opening 52 which is generally like the openings 32,33, but inverted, with a wide opening 54 at the top 50 to a narrower opening 55 at the bottom 51 and a tapered as well as curved surface 56 in between. The wide opening 54 is preferably exactly the same in dimension as the entry opening 34 of the step since it will mate against it. The wedge collar 17 also has bolt openings 57,58 through which the bolt openings 37,38 align and through which the bolts 40 are inserted, preferably from the top, with nuts 60 on the bottom that are tightened against a ledge 61, for which a recess 62 is provided, to hold the collar 17 in place against the step 15 or 16.

Figure 6:
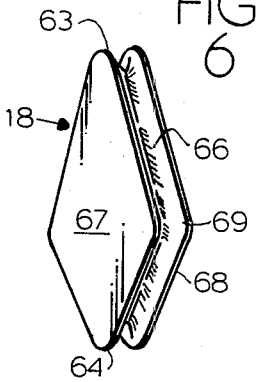
FIG. 6 is an isometric view of a wedge heart used in the invention.
Figure 4:
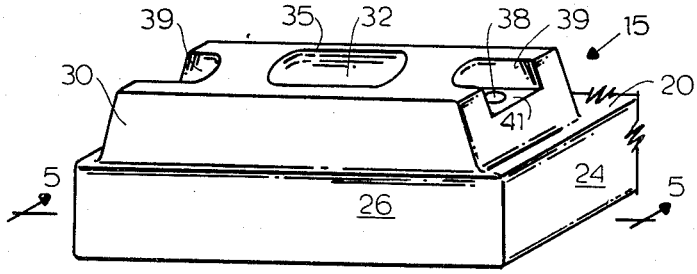
FIG. 4 is an enlarged isometric view of one end of a step, with the remainder of the step broken off to conserve space.

The wedge heart 18 (FIG. 6) is of generally diamond shape, having a vertex 63 at the top and a vertex 64 at the bottom and with concave rope guides or grooves 65 and 66 along its two opposite edges; it has flat side faces 67 and 68 as shown in FIGS. 6 and 9. Each wedge heart 18 is inserted between the two ropes 11,12 or 13,14 and lies with its widest portion 69 at about the plane where the lower surface 21 of the step 15 and the upper surface 50 of the wedge collar meet; its upper apex 63 lies at about the upper face of the portion 30 in the outlet 35, while its lower apex 64 lies at about the lower outlet 55 from the wedge collar 17. When fully wedged in place, the grooves 65 and 66 are parallel to the curved end walls of the openings 37 and 38 of the step 15 or 16 and to the curved end walls of the openings 52 of the wedge collar 17. The heart 18 then locks the step 15 (or 16), the wedge collar 17, and itself to the ropes 11,12 or 13,14, so that relative movement between them cannot take place.

Since the completed wedging is so tight and since slippage is not permitted, installation of the device is preferably accomplished as shown in FIGS. 12–14. The rope ladder 10 is preferably assembled from the bottom up, the bottommost step 15 being assembled first; and the parts 15, 16, and 17 are threaded on the rope 11,12 and 13,14 in advance. Assembly of an intermediate step 15 is shown. A rigid anvil member 70 is secured to a pair of vertical supports 71,72 which are secured firmly to a suitable rigid vertical support or wall 73. The upper edge 20 of a next upper step 15 is brought up against the lower surface of the anvil 70. Below the anvil 70 and below that step 15 is a pair of hydraulic cylinders 74,75, secured to the supports 71,72 and resting on a base plate 75*a*, which is placed on the next-below step 15*a*, which has already been secured in place, as by a previous use of the assembly device. Each cylinder 74,75 as a rod 76,77 connected to its piston (not shown). The rods 76 and 77 support a crosshead 78. A wedge collar 17, after having been threaded through its ropes, is inserted on an end shelf 79 at each end of the crosshead 78, and a wedge heart 18 is inserted in between each pair of ropes 11,12 and 13,14. Then, hydraulic pressure is exerted to raise the crosshead 78 as shown in FIG. 13, finally bringing it up to the position shown in FIG. 14, in which both wedge collars 17,17 have their upper surfaces 50 bearing against the bottom surface 21 of the step 15 and the wedge hearts 18,18 in the position where they lock the assembly together, all as shown in enlarged form in FIG. 9. This action of the cylinders 74,75 also acts to exert a strong stretching force on the ropes 11,12 and 13,14 in between the steps 15 and 15a, helping to assure tautness and to secure the wedging action simultaneously. Then, the bolts 40 are inserted and the nuts 60 tightened on them to hold the assembly together. Then, the next step 15 and its associated elements are extended in the same manner.

For a pilot's ladder 10, the steps 15 are about twenty inches long, about five inches wide, and about an inch thick at the tread. The elongated steps 16 are typically about seventy inches long, and the openings 49 about two inches by eight inches, there being two openings 49 on each side of each step 16. For a forty-foot ladder, there are usually four of the elongated or spreader steps 16.

In addition to serving their usual functions, the spreader steps 16 of this invention solve several problems. Conventional wooden spreaders tend to catch the wind, and when they do, they tend to cause the ladder to twist or spin, thereby making ascent or descent dangerous, if not impossible. The openings 49 let the wind pass through the outboard positions 46 and 47 and greatly reduce the wind resistance, thereby significantly increasing the ladder's safety. Furthermore, the rims 48, due to the openings 49, serve as hand holds when needed, as on windy days and nights, thereby adding another safety feature. Beyond all this, the openings 49 lighten the weight of the ladder 10 considerably, and weight is always a consideration for pilot ladders. On a forty-foot ladder 10 with four spreader steps 16, the open area is about $2'' \times 8'' \times 4 \times 4 = 256$ square inches, and at one inch thick, this open area is equivalent to reducing the weight by the weight of a $4'' \times 1''$ board about five and one-half feet long.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A rope ladder of the type having a series of ladder steps, each with an upper surface and a lower surface, two longitudinal edges and two end edges, and two spaced-apart pairs of ropes, the improvement wherein:

each said step is a molded one-piece hard elastomer member having two spaced-apart vertical through openings, one spaced in from each said edge, each said through opening being narrow at its upper end for closely confining said ropes and being much wider than that where it emerges from said lower surface, each through opening tapering inwardly from bottom to top, each said step having vertical bolt openings therethrough adjacent each said through opening, a pair of separate wedge collars for each said step, one at each end of and below said step and bearing up against it, each said wedge collar having a single elongated through opening whose upper end is approximately the same width as said step's through opening where it emerges from its lower surface, said elongated through opening tapering inwardly therefrom down to a narrow portion at the lower end for closely confining the two ropes, each said wedge collar having vertical bolt passages therethrough aligned with the bolt openings through said step, a generally diamond-shaped wedge heart in between the said ropes of each pair of ropes, a said heart lying in each through opening of each step and extending into each said elongated through opening of said wedge collar, said wedge heart having an upper vertex adjacent said upper end of said step's through opening and a lower vertex adjacent the bottom of the elongated through opening of said wedge collar, and providing two rope-engaging side grooves extending between and ending at said vertices, so that these rope-engaging grooves, when said wedge heart is fully wedged in place, lock the pair of ropes in place and prevent relative movement between them and said step, said wedge collar and said wedge heart, and fastening means extending through the bolt passages of each wedge collar and the bolt openings of each step and tightened in place to hold said wedge collar and wedge heart in place and lock said ropes in fixed position relative to said wedge heart, said step, and said wedge collar.

2. The rope ladder of claim 1 wherein said step is reinforced by rib means extending down from the lower surface thereof.

3. The rope ladder of claim 1 wherein said upper surface of said step comprises a molded antiskid surface and numerous particles of grit adhered thereto.

4. The rope ladder of claim 1 wherein said wedge heart flares outwardly from both said vertices, meeting at side vertices that are substantially in line with the lower surface of the step and the upper surface of the wedge collar, the grooves thereof being parallel to the opposing walls of the through openings for the step and the wedge collar.

5. The rope ladder of claim 1 having at intervals an elongated molded step having an outboard portion integral with the step at each end, each said outboard portion comprising border portions and openings surrounded by said border portions.

6. A method for assembly of a rope ladder of the type having a series of ladder steps, each having two spaced-apart vertical through openings, one spaced in from each end, and each tapering inwardly from bottom to top, and a pair of separate wedge collars for each step with opening aligned with those of the step, threading two pairs of ropes alternately through the steps and wedge collars, bringing a wedge collar up close to the bottom of each step at each end, inserting a generally diamond shaped wedge heart in between each pair of ropes and in between each collar and its step, holding said step in place against an anvil on its upper surface, and hydraulically forcing both said wedge collars for that step upwardly until the upper surface of the wedge collar engages the lower surface of said step.

7. The method of claim 6 in which simultaneously with said forcing step there is a step of bringing downwardly exerted pressure against a next-lower step which has already been assembled, thereby stretching said ropes and forcing the wedge heart up into place.

8. A rope ladder of the type having a series of ladder steps, each with an upper surface and a lower surface, two longitudinal edges and two end edges, and two spaced-apart pairs of ropes, the improvement wherein each said step is a molded one-piece hard elastomer member having two spaced-apart vertical through openings, one spaced in from each said step edge, and having at the upper end of each opening an integral wedging portion surrounding said opening on and above said upper surface, each said through opening being at its outlet from said wedging portion approximately twice the diameter of each said rope, to closely confine the two ropes of each said pair, and being much wider than that where it emerges from said lower surface, each opening tapering inwardly from bottom to top and being arcuate at each end, each said step having a pair of vertical bolt openings therethrough adjacent each said through opening, a pair of separate wedge collars for each said step, one at each end of and below said step and bearing against it, each said wedge collar having a step-engaging end wall and a distal end and a single elongated through opening through which one pair of ropes passes and which at said step-engaging end is approximately the same width as said step's through opening where it emerges from the bottom surface, said elongated through opening tapering inwardly from said step-engaging end down to a narrower portion of said elongated opening at the distal end, which is barely wide enough for the two ropes to pass therethrough, each said through opening being arcuate at each end, each said wedge collar having an elongated pair of vertical bolt passages therethrough aligned with the bolt openings through said step, a generally diamond-shaped wedge heart in between the said ropes of each pair of ropes, a said heart lying in each through opening of each step and extending into each said elongated through opening of said wedge collar, said wedge heart having an upper vertex adjacent said upper outlet of said step's through opening and a lower vertex at its lower end adjacent the bottom of the elongated through opening of a said wedge collar, and providing two rope-engaging side grooves extending between and ending at said vertices, each groove being arcuate and being parallel to the arcuate ends of the through openings it faces, so that these rope-engaging grooves, when said wedge heart is fully wedged in place, lock the pair of ropes in place and prevent relative movement between the ropes and said step, said wedge collar and said wedge heart, and a pair of bolts, each with a nut, extending through the bolt passages of each wedge collar and the bolt openings of each step, to hold said wedge collar and wedge heart in place and lock said ropes in fixed position relative to said wedge heart, said step, and said wedge collar.

9. A step for a rope ladder, comprising a molded one-piece hard elastomer member with an upper surface and a lower surface, two longitudinal edges, two end edges, and two spaced-apart, vertical rope-receiving, through openings, one spaced in from each said end edge, said member having at the upper end of each through opening an integral wedging portion surrounding said opening on and above said upper surface, each said through opening having a narrow oulet from said wedging portion approximately twice the diameter of the rope it is to receive, for the reception of two such ropes, and being much wider than that where it emerges from said lower surface, each opening tapering inwardly from bottom to top and arcuate at each end, each said step having a pair of vertical bolt openings therethrough adjacent each said through opening.

10. The step of claim 9 having an antiskid said upper surface comprising a patterned tread and numerous particles of grit adhesively retained thereon.

11. The step of claim 9 having strengthening rib means extending down from its lower surface.

12. The step of claim 9 having, molded as a part thereof, an outboard portion at each end extending well beyond said openings and comprising a border of molded elastomer surrounding open areas.

* * * * *